US006577089B1

(12) United States Patent
Piedl et al.

(10) Patent No.: US 6,577,089 B1
(45) Date of Patent: Jun. 10, 2003

(54) PRESSURE CONTROL SYSTEM USING INPUT CURRENT SENSING

(75) Inventors: Martin Piedl, Blacksburg, VA (US); Moe K. Barani, Radford, VA (US); Ron Flanary, Blacksburg, VA (US)

(73) Assignee: Aspen Motion Technologies, Inc., Radford, VA (US)

( * ) Notice: Subject to any disclaimer, the term of this patent is extended or adjusted under 35 U.S.C. 154(b) by 0 days.

(21) Appl. No.: 09/806,364

(22) PCT Filed: Oct. 28, 1999

(86) PCT No.: PCT/US99/25297

§ 371 (c)(1),
(2), (4) Date: Sep. 21, 2001

(87) PCT Pub. No.: WO00/25416

PCT Pub. Date: May 4, 2000

Related U.S. Application Data

(60) Provisional application No. 60/105,994, filed on Oct. 28, 1998.

(51) Int. Cl.[7] ..... H02P 7/00

(52) U.S. Cl. ..... 318/432; 318/434; 388/929; 388/930; 388/800

(58) Field of Search ..... 60/419; 417/366; 388/929, 930, 800; 318/432, 434

(56) References Cited

U.S. PATENT DOCUMENTS 4,397,610 A * 8/1983 Krohn ..... 417/44.2
5,293,745 A * 3/1994 Roche ..... 60/419

* cited by examiner

*Primary Examiner*—Karen Masih
(74) *Attorney, Agent, or Firm*—Quarles & Brady LLP

(57) ABSTRACT

A method and apparatus for controlling the output function of a permanent magnet brushless DC motor (20), by sensing an input current to the motor (20), by computing an output torque generated by the motor (20) as a function of the input current to the motor (20), by computing an output pressure for a pump (22) in response to the output torque, by reading a set point pressure, and by comparing the set point pressure to the output pressure, and in response thereto controlling on-off operation of the motor (20). The apparatus includes a sensing circuit (28) and a microelectronic processor (30) for performing these functions.

2 Claims, 2 Drawing Sheets

PRESSURE CONTROL SYSTEM USING INPUT CURRENT SENSING

This application claims benefit of provisional application 60/105,994 filed Oct. 28, 1998.

FIELD OF THE INVENTION

This invention relates to a system for controlling a motor driven function by sensing the input current to the motor, and more particularly controlling the pressure of a pump by sensing the input current to a permanent magnet (PM) brushless motor.

DESCRIPTION OF THE PRIOR ART

Presently, many fluid pumps, including air compressors, use series wound (universal) brush motors that are powered directly from an AC power line. While inexpensive, these motors have certain drawbacks. Among these are brush wear which can limit the useful life of the equipment, and sparking of the commutator, which may be a hazard in certain environments. The pressure in these pump systems is controlled by energizing a motor when the pressure drops below a set point threshold and de-energizing the motor when it rises above the set point threshold. A pressure sensor, either a mechanical type that directly operates a motor energizing switch or a strain gauge type that electronically controls such a switch, regulates the pressure. Brushless DC motors have not been commonly known in these applications, due to the extra cost of the motor controller which is necessary to control such a motor.

SUMMARY OF THE INVENTION

The invention is practiced in a method and apparatus for controlling the output function of a permanent magnet brushless DC motor, by sensing an input current to the motor, by computing an output torque generated by the motor as a function of the input current to the motor, by computing an output pressure for a pump in response to the output torque, by reading a set point pressure, and by comparing the set point pressure to the output pressure, and in response thereto, controlling on-off operation of the motor.

The invention provides for estimating the output pressure from input current, which allows for control of a pump without the use of a pressure sensor.

The foregoing and other objects and advantages of the invention will become apparent from the following detailed description of a preferred embodiment of the invention, in which reference is made to the drawings, which form a part hereof, and which illustrate a preferred embodiment of the invention. Such description is given, by way of example, and not by way of limitation, and for scope of the various embodiments of the invention, reference is made to the claims which follow the description.

DETAILED DESCRIPTION OF A PREFERRED EMBODIMENT

Figure 1:
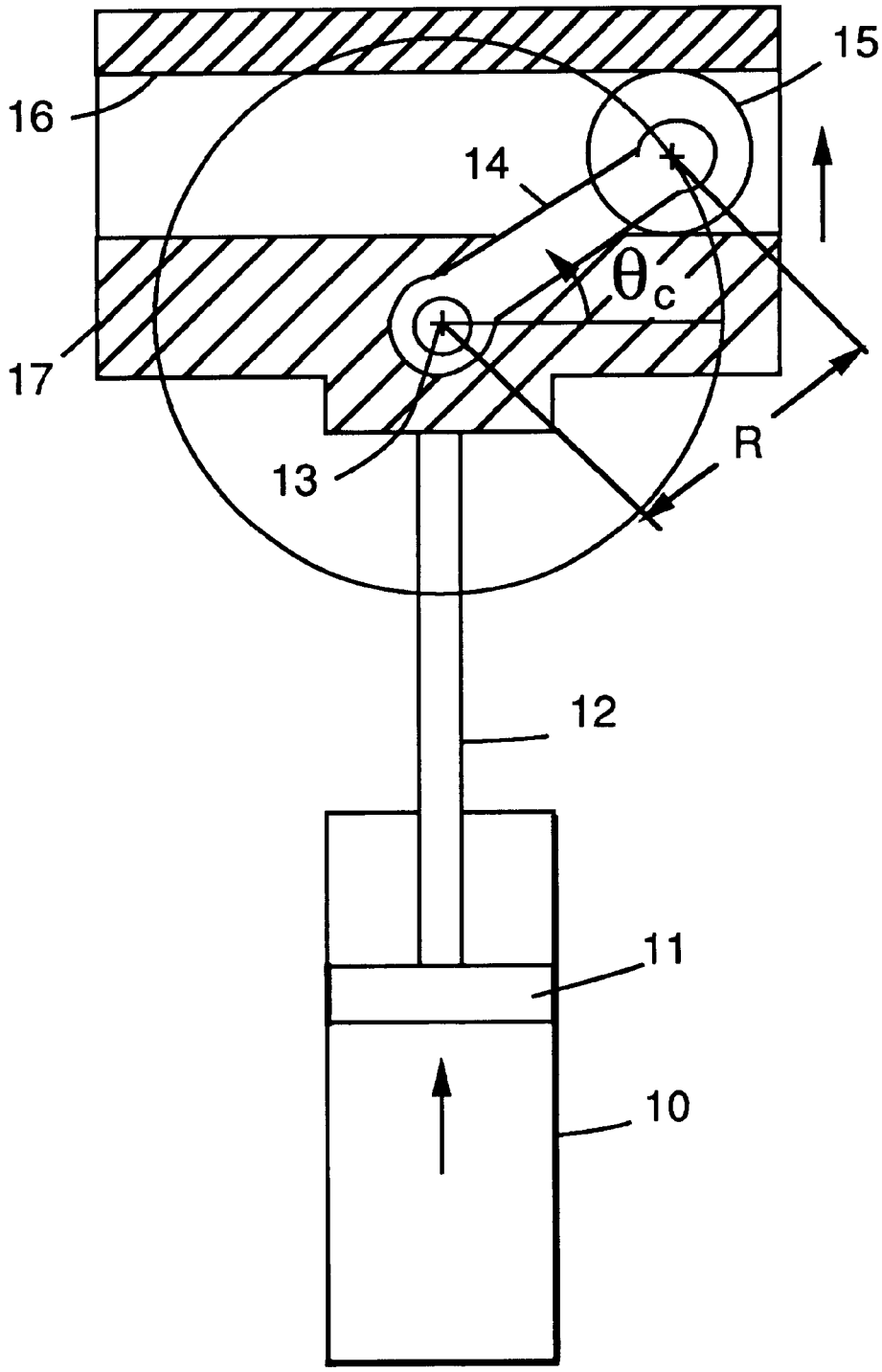
FIG. 1 is a detail sectional view in elevation of a piston-cylinder portion of a pump which is controlled with the present invention.

FIG. 1 illustrates a crank mechanism for coupling a brushless DC motor (not shown) to a piston rod 12. The piston rod 12 connects to a piston 11 inside a cylinder 10. The motor output shaft connects through a gear reduction mechanism (not shown in FIG. 1) and an output drive shaft 13 which connects to one end of a crank arm 14 and provides a stationary axis around which the crank arm 14 rotates. The other end of the crank arm 14 is connected to a roller 15. The roller 15 moves in a slot 16 in coupling block member 17 which is fastened to one end of the piston rod 12. As the drive shaft 13 rotates, it causes pivoting of the crank arm 14 around the stationary axis provided by drive shaft 13. As the crank arm 14 rotates 360° around stationary axis 13, the coupling member 17 moves up and down to draw the piston 12 in one direction and then drive it in the opposite direction into the cylinder 12 in a reciprocating motion.

In a reciprocating pump, the relationship between crankshaft torque and piston force in nonlinear. For example, in relation to FIG. 1, $$T_c = FR|\cos\theta_c| \tag{1}$$

where $T_c$ is the torque on the crank, R is the length of the crank arm 14, $\theta_c$ is the angle of the crank arm 14. The absolute value is due to this pump being of a "double-acting" type, that is, it pumps in both directions. F is the piston force, which is given by, $$F = A_p P + f_p \tag{2}$$

where $A_p$ is the piston area, P is the cylinder pressure, and $f_p$ is the friction of the piston 11 moving inside the cylinder.

In many applications, it is more practical to use a higher speed motor and a gear reduction mechanism to drive a high-pressure pump. In such cases, there is not a one-to-one correspondence between the motor output shaft angle position and the crankshaft (or piston) position. The relationship between motor torque and crank torque may be expressed as:

$$T_c = nkT_m \tag{3}$$

where n is the gearbox efficiency, k is the gear ratio, and $T_m$ is the motor torque. The relationship between the angle of the motor output shaft and the position of the crank 14 may be expressed as:

$$\theta_m = k\theta_c \tag{4}$$

where $\theta_m$ is the angle of the motor output shaft. These are mechanical relationships that vary depending on the application.

$$T_m = K_t I \tag{5}$$

Equation (5) expresses the relationship between motor torque $T_m$ and motor current I, where $K_t$ is the motor torque constant. $K_t$ is not truly a constant as there is a position dependent torque ripple, which is more severe in six-step commutated (as opposed to sine-wave commutated) motors. This may limit the accuracy of the pressure estimate when used with six-step commutated motors. Also, $K_t$ varies somewhat with the magnitude of the current, especially at high current levels.

The non-linearity of the mechanics makes the problem of estimating pressure from current difficult. A further technical difficulty is encountered because the parameters $f_p$, n, and $K_t$ are not well defined. The parameters, $f_p$ and n are, in general, dependent on numerous variables, including pressure, speed, temperature, viscosity and mechanical wear. The parameter, $K_t$, is dependent to some extent on temperature and motor current. These dependencies may change over time and vary widely from unit to unit. It may be desirable to attempt to compensate for some of these effects, for example, by defining a typical $K_t$ vs. motor current function.

If it is desirable to maintain a relatively constant pressure, as opposed to regulating pressure to a specific value, then the problem may be simplified. This would be the case if an operator were to set the pressure set point to some desired level and adjust the set point if needed. In this case, the main concern is the behavior of the controller in the vicinity of the set point pressure. The effects of friction and efficiency can be regarded as a constant offset to the pressure estimate, and therefore ignored.

It can be seen from the equations above that the crank position value is required in order to estimate the pressure. It is not possible to obtain this directly from the motor position in general because a gearbox is typically used. Although it is possible to add a position sensor to the crank, this would add cost to the system and offset the savings obtained by eliminating the pressure sensor.

Therefore, before the pressure can be estimated, the crank position relative to the motor has to be estimated. Once this relationship is determined, the crank position can be derived from the motor position since the gear ratio is fixed and known.

The preferred method for determining crank position is by operating the pump at a relatively low, constant speed. The current command varies with the load, peak current occurring at the points where piston speed is at a maximum, for example at 0 and 180 degrees in FIG. 1. The motor current is sampled and fitted to an expected current function, using least square error or some similar criteria. The peak of the sampled current data is taken to coincide with the peak load crank positions.

Pressure is determined from solving equation (2) for P by substituting equations (1), (3) and (5). The resulting expression for P is:

$$P = \frac{nkK_T I}{AR|\cos\theta_c|} - \frac{f_p}{A} \tag{6}$$

The $f_p/A$ term can be considered constant at the set point pressure and ignored, if a constant error is acceptable.

Once the pressure set point is reached, as determined from the motor current and crank position, the pump is stopped. A further technical problem is the lack of availability of sampled current data when the motor is not running. In order to obtain sampled current data, the motor is periodically energized and its motion is observed. If sufficient motion is noted (through its shaft angle sensor), it is assumed that the pressure has dropped and the pump is restarted.

Because the current measurement is noisy and other sources of error are present, it is necessary to use statistical methods when processing the sampled current data. Such methods include taking redundant measurements, detecting outlying measurements, and filtering.

Figure 2:
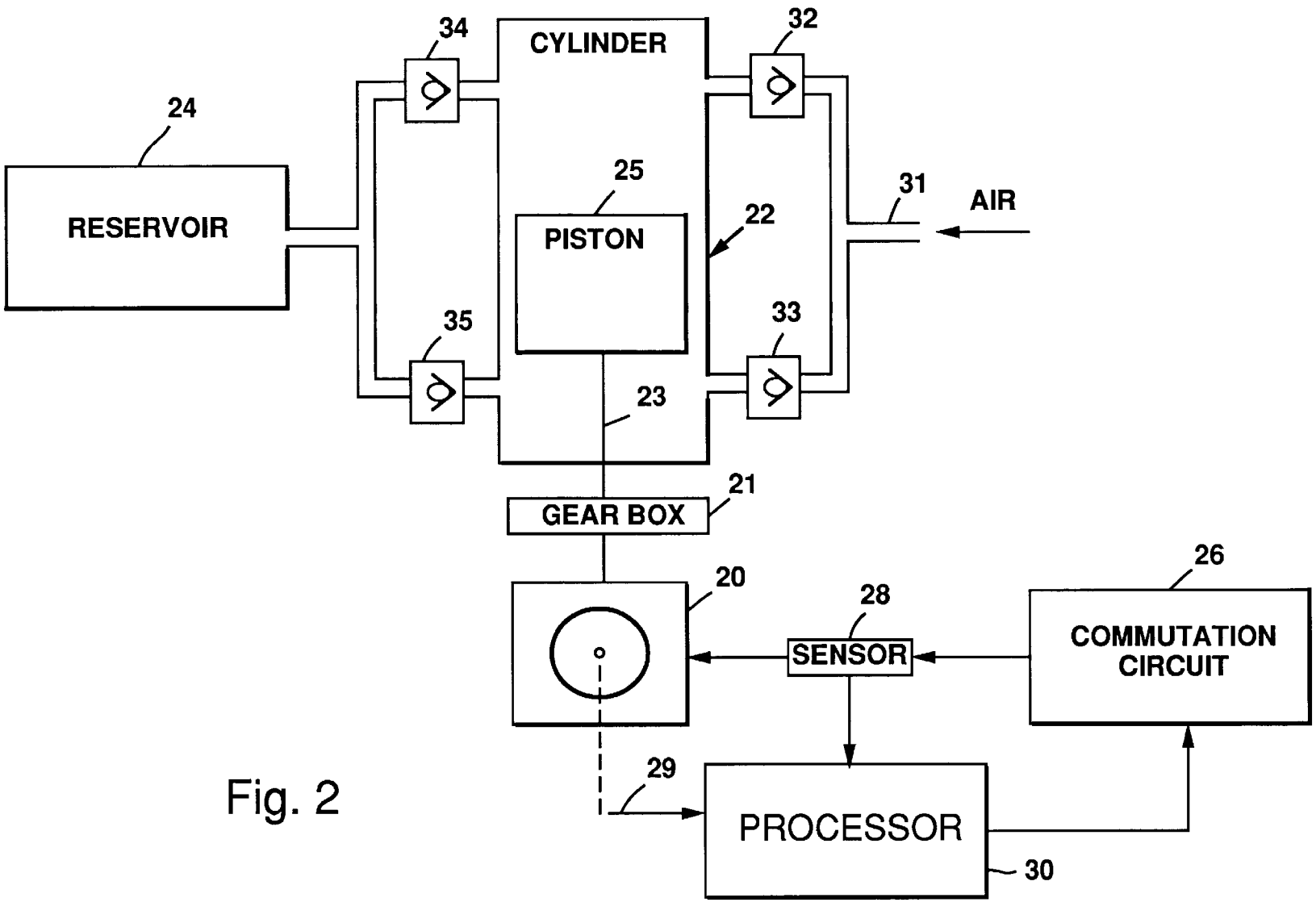
FIG. 2 is a block diagram of a motor control according to the present invention.

Referring now to FIG. 2, a brushless permanent magnet DC motor 20 drives a reciprocating piston-cylinder portion 22 of a pump, as described in relation to FIG. 1, in order to build pressure in a reservoir 24, for example, in a paint spray system. The piston 25 is a double-acting piston, which produces output pressure to the reservoir 24 in both of its opposite stroke directions. The invention is also applicable to single-acting piston pumps. To provide a double-acting piston, two fluid inlets are provided from a source inlet 31, through respective check valves 32 and 33. Similarly, on the output side, two fluid outlets are provided to an inlet to the reservoir 24 through check valves 34 and 35.

The objective of such a system is to maintain the pressure in the reservoir 24 at a target pressure. In such a system, the reservoir may take the form of a paint supply line to be maintained at a target pressure.

The motor 20 receives input current from a commutation circuit 26 through a current sensor 28. A microelectronic processor 30 is provided with memory and a stored program for controlling operations of the commutation circuit 26, and for sensing input current from current sensor 28. The processor 30 also receives shaft angle and velocity feedback from a sensor on the output shaft of the motor 20, as represented by input 29.

The motor 20 has a torque constant $K_t$ stated, for example, in pounds feet per direct current amperes (1 b-ft/DC amps).

By the nature of reciprocating pumps, there is a cyclical torque output required from the motor. As the piston 25 in FIG. 2 begins to compress, the torque level increases until it reaches the point of maximum compression which corresponds the maximum torque level. Likewise, when the piston 25 in FIG. 2 is in a position of minimum compression, the torque level required is minimum.

With the aforementioned technique, the pressure can be determined based on the motor current. The current is sensed by current sensor 28 and periodically read into the processor 30. The processor 30, operating under instructions in a stored program, calculates an output torque generated by the motor as a function of the input current to the motor 20. The processor 30 then calculates an output pressure for a pump in response to the output torque according to the relationships described above. The processor 30 then reads a set point pressure and compares the set point pressure to the calculated output pressure. In response to the result, the processor controls the on-off operation of the motor 20 through control of the commutation switches 16.

Once the desired pressure level is achieved, the motor 30 is turned off for a predetermined period of time. After this time period expires, the motor 30 will be re-energized for attempted rotation. If the processor 30 detects a pressure level in excess of, or equal to, the desired pressure level, it will de-energize the motor 20. The process of checking whether the pressure level is equal to or in excess of the target pressure level will continue until:

1) the pressure detected is less than the set point pressure (the motor will continue rotating as long as the set point pressure is not met); or 2) until the pump system is turned off.

While this invention has been described in terms of a single preferred embodiment, those skilled in the art will recognize that the invention can be practiced with modification within the spirit and scope of the appended claim.

We claim:

1. A motor control for controlling the output function of a permanent magnet brushless DC motor, said motor control comprising:

a sensor for sensing input current to the motor;

a processor including a stored program for calculating an output torque generated by the motor as a function of the input current to the motor;

said processor also calculating an output pressure for a pump in response to the output torque; and said processor reading a set point pressure and comparing said set point pressure to said output pressure, and in response thereto, controlling on-off operation of the motor.

2. A method of controlling the output function of a permanent magnet brushless DC motor, said method comprising:

sensing an input current to the motor;

computing an output torque generated by the motor as a function of the input current to the motor;

computing an output pressure for a pump in response to the output torque;

reading a set point pressure; and comparing said set point pressure to said output pressure, and in response thereto, controlling on-off operation of the motor.

* * * * *